US006551374B2

(12) United States Patent
Doh et al.

(10) Patent No.: US 6,551,374 B2
(45) Date of Patent: Apr. 22, 2003

(54) METHOD OF CONTROLLING THE MICROSTRUCTURES OF CU-CR-BASED CONTACT MATERIALS FOR VACUUM INTERRUPTERS AND CONTACT MATERIALS MANUFACTURED BY THE METHOD

(75) Inventors: Jung Mann Doh, Seoul (KR); Jong Ku Park, Kyongki-do (KR); Mi Jin Kim, Junnam (KR)

(73) Assignee: Korea Institute of Science and Technology, Seoul (KR)

( * ) Notice: Subject to any disclaimer, the term of this patent is extended or adjusted under 35 U.S.C. 154(b) by 0 days.

(21) Appl. No.: 09/828,969

(22) Filed: Apr. 10, 2001

(65) Prior Publication Data

US 2002/0068004 A1 Jun. 6, 2002

(30) Foreign Application Priority Data

Dec. 6, 2000 (KR) ..... 2000-73926

(51) Int. Cl.[7] ..... B22F 3/24; C22C 9/00

(52) U.S. Cl. ..... 75/247; 419/27; 419/29; 419/47; 419/48

(58) Field of Search ..... 419/27, 47, 48, 419/29; 75/245, 247

(56) References Cited

U.S. PATENT DOCUMENTS 4,008,081 A * 2/1977 Hundstad
4,302,514 A * 11/1981 Kato et al. ..... 428/569
4,640,999 A * 2/1987 Kashiwagi et al. ..... 200/144 B
4,659,885 A * 4/1987 Kashiwagi et al. ..... 200/144 B
4,766,274 A * 8/1988 Iyer et al. ..... 200/144 B
4,853,184 A * 8/1989 Naya et al. ..... 420/489
4,870,231 A * 9/1989 Naya et al. ..... 200/266
5,241,745 A * 9/1993 Kippenberg ..... 29/875
5,726,407 A * 3/1998 Okutomi et al. ..... 218/130

* cited by examiner

*Primary Examiner*—Ngoclan Mai
(74) *Attorney, Agent, or Firm*—Rosenberg, Klein & Lee

(57) ABSTRACT

The present invention relates to a method of controlling the microstructures of Cu—Cr-based contact materials for vacuum interrupters, in which a heat-resistant element is added to the Cu—Cr-based contact materials to obtain an excellent current interrupting characteristic and voltage withstanding capability, and contact materials manufactured thereby. The method of controlling the microstructures of Cu—Cr-based contact materials includes the steps of mixing a copper powder used as a matrix material, a chromium powder improving an electrical characteristic of the contact material and a heat-resistant element powder making the chromium particles in the matrix material fine to thereby obtain mixed powder, and subjecting the mixed powder to one treatment selected from sintering, infiltration and hot pressing to thereby obtain a sintered product.

9 Claims, 3 Drawing Sheets

METHOD OF CONTROLLING THE MICROSTRUCTURES OF CU-CR-BASED CONTACT MATERIALS FOR VACUUM INTERRUPTERS AND CONTACT MATERIALS MANUFACTURED BY THE METHOD

BACKGROUND OF THE INVENTION

1. Field of the Invention

The present invention relates to a method of controlling the microstructures of a Cu—Cr-based contact material for a vacuum interrupter and a contact material manufactured by the method, in which heat-resistant metal elements are added to the Cu—Cr-based contact material in order to obtain an excellent current interrupting characteristic and an excellent voltage withstanding capability.

2. Description of the Related Art

Generally, a vacuum interrupter has excellent current interrupting and voltage withstanding capabilities, long service life, low maintenance cost without frequent repair, a simple structure, small size, environmental compatibility, and inertness from an external environment. Therefore, the vacuum interrupter has been widely used in all kinds of power distribution installation, industrial power installation and intermediate voltage vacuum breakers for national defense, education and science researches. The performance of the vacuum interrupters used for the various purposes is dependent upon an arc characteristic exhibited between the contact surfaces during current interrupting, and the arc characteristic is dependent upon characteristics of contact materials.

Accordingly, the contact material is one of most important factors that determine the performance of vacuum interrupters (For example, see Vol. CHMT-7, pp.25 (1984), The Vacuum Interrupter Contact, IEEE Transaction on Components, Hybrids, and Manufacturing Technology, Paul G. Slade).

The contact materials have to satisfy the following characteristics, in order to execute satisfactorily their function: (1) excellent large current interrupting ability; (2) high voltage withstanding capability; (3) low contact resistance; (4) excellent deposition-resistant characteristic; (5) low amount of consumption (abrasion) of contact; (6) low current chopping value; (7) excellent workability; and (8) sufficient mechanical strength (See U.S. Pat. No. 5,853,083 (1998), issued to Furushawa et al.; U.S. Pat. No. 5,882,488 (1999), entitled "Contact Material for Vacuum Valve and Method of Manufacturing the Same, issued to T. Seki, T. Okutomo, A. Yamamoto, T, Kusano; U.S. Pat. No. 4,870,231 (1989), entitled "Contact for Vacuum Interrupter, issued to E. Naya, M. Okumura; and Vol. 21, No.5, (1993) pp. 447, Contact Material for Vacuum Switching Devices, IEEE Transactions on Plasma Science, F. Heitzinger, H. Kippenberg, Karl E. Saeger, and Karl-Heinz Schroder).

The Cu—Cr-based contact materials for the vacuum interrupters had been developed and manufactured in U.S.A. and U.K. before 1970's and then have been rapidly extended into Europe and Japan after 1980's. At present, the Cu—Cr-based contact materials for the vacuum interrupters have been widely used in all over the world. Specifically, until 1980, among the breaker manufacturing companies only four companies of Westinghouse, English Electric, Siemens and Mitsubishi had used the Cu—Cr-based contact material for the commercial purpose. Since 1980s, the characteristics of Cu—Cr-based contact materials have been drastically improved and the Cu—Cr based contact materials have been used in most of commercial intermediate voltage/high current breakers since 1990's (For example, see Vol. 17, No. 1 (1994) pp. 96, IEEE Transaction on Components, Packaging, and Manufacturing Technology, Paul E. Slade).

Recently, since the application conditions of the contact materials become more complicated and the application range thereof is being extended from an existing cut-off circuit to reactors circuit and electricity storing (capacitor) circuit areas, there is a need to enhance the properties of Cu—Cr-based contact materials that exhibit an excellent current interrupting ability and an high voltage withstanding capability, compared with the existing Cu—Cr based contact materials. In other words, the voltage of the capacitor circuit is twice that of an ordinary circuit, and the restrike of arc in a circuit where an inrush current requiring an excellent high current interrupting characteristic is passed causes a serious problem. To solve these problems, it is necessary to improve the current interrupting and voltage withstanding capabilities in the Cu—Cr-based contact materials.

To improve the properties of the Cu—Cr-based contact materials, the metallic elements such as Mo, W, Nb, Pt, Ta, V and Zr can be added, which results in homogenous microstructes as well as refined Cr particles dispersed in the Cu matrix.

In the conventional manufacturing method for Cu—Cr contact materials, a chromium powder of about 40 $\mu$m in average diameter is used to improve the current interrupting and voltage withstanding capabilities of Cu—Cr-based contact material. (See U.S. Pat. No. 5,882,488 (1999), entitled "Contact Material for Vacuum Valve and Method of Manufacturing the Same, issued to T. Seki, T. Okucomo, A. Yamamoto, T, Kusano).

This conventional method is not desirable to obtain Cu—Cr contact materials of high performance with fine grain structures.

The fine chromium powder results in a rise in the production cost of the Cu—Cr-based contact materials and formation of a detrimental tight chromium oxide on the powder surface, which inhibits full densification and causes high oxygen content. In order to manufacture the Cu—Cr-based contact materials with homogeneously fine chromium grain structures from a coarse chromium powder, it is necessary to invent a new technology which allows us to control easily Cu—Cr microstructures.

It is known that if at least one element selected from Mo, W, Ta, Nb, V and Zr is added to the Cu—Cr-based contact material or if the chromium particles in the Cu—Cr-based alloys are fine, the current interrupting and voltage withstanding capabilities of the vacuum breakers is improved. Thus, the fine chromium powder having the average diameter of about 40 $\mu$m has been used in the conventional manufacturing process of the Cu—Cr based contact material. This fine Cr powder causes some serious problems in manufacturing the Cu—Cr alloys as well as in the production cost. (See U.S. Pat. No. 5,882,488 (1999), entitled "Contact Material for Vacuum Valve and Method of Manufacturing the Same", issued to T. Seki, T. Okutomo, A. Yamamoto, T, Kusano; U.S. Pat. No. 4,870,231 (1989), entitled "Contact for Vacuum Interrupter", Issued to E. Naya and M. Okumura; Korean Pat. No. 1609 (1989; Korean Pat. No. 1035 (1993)).

To overcome these problems, there is a need to develop a new technology for microstructure control in manufacturing the Cu—Cr-based contact materials from the coarse chromium powder as a material.

SUMMARY OF THE INVENTION

Accordingly, it is an object of the present invention to provide a method of controlling the microstructures of Cu—Cr-based contact materials for vacuum interrupters and contact materials manufactured by the method, in which desirable microstructures are embodied to thereby exhibit the excellent large current interrupting and high voltage withstanding capabilities.

To accomplish this object of the present invention, there is provided a method of controlling the microstructures of Cu—Cr-based contact materials for vacuum interrupters, which comprises the steps of: mixing a copper powder improving electrical characteristics of the contact materials as a matrix material, a chromium powder and a heat-resistant element powder making the chromium particles in the matrix material fine to thereby obtain a mixed powder; and subjecting the mixed powder to one treatment selected from sintering, infiltration and hot pressing to thereby obtain a sintered product.

DETAILED DESCRIPTION OF THE PREFERRED EMBODIMENT

Figure 1:
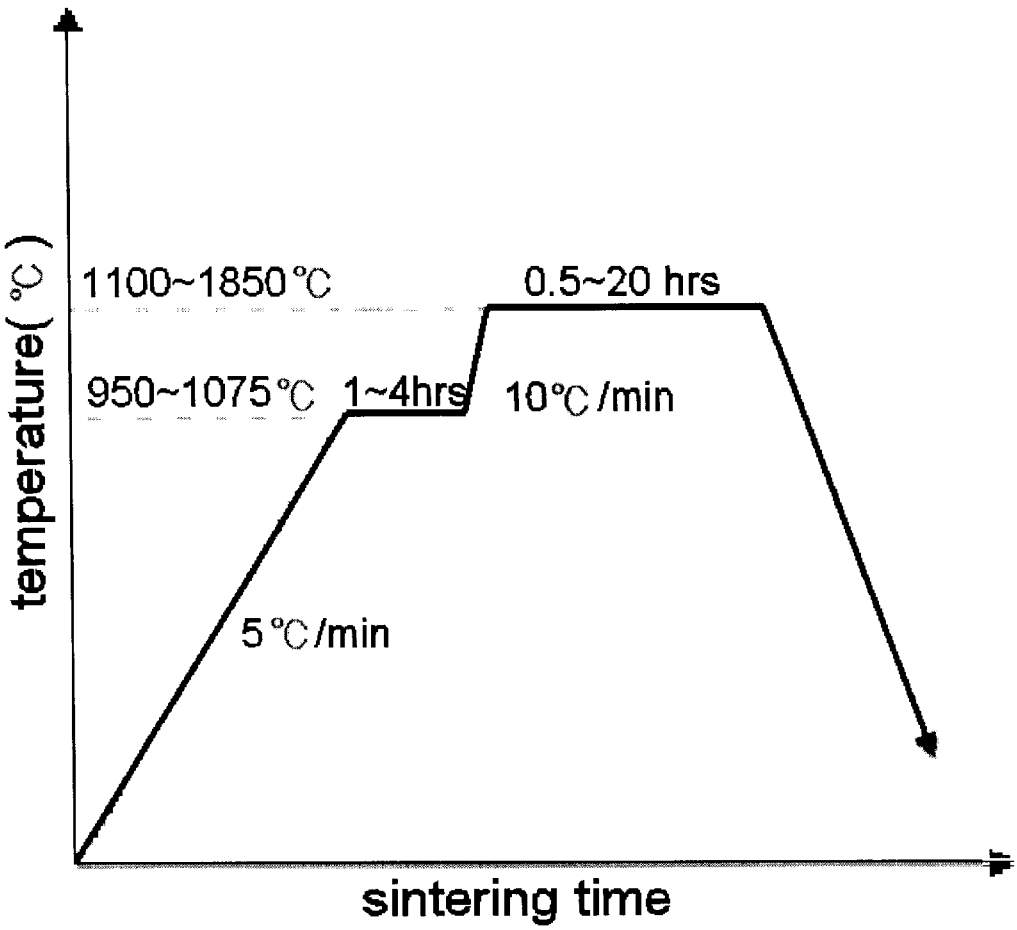
FIG. 1 is a schematic illustration on a heating (or sintering) process for manufacturing a Cu—Cr-based contact material according to the present invention.

To improve the characteristics of the Cu—Cr based contact materials, a heat-resistant metal elements such as W, Mo, Ta, Pt, Nb, V and Zr is added to the copper and chromium powders, and the refinement of the chromium particles is achieved. The alloying process of the chromium with the added elements (W, Mo, Ta, Pt, Nb, V and Zr) is accelerated through the precipitation of the fine Cr—X alloying particles (X is an alloying element such as W, Mo, Ta, Pt, Nb, V or Zr), in which the Cr—X particles contain at least one element selected from the added elements.

The Cu—Cr-based contact materials manufactured by the present invention exhibits the combined effects obtained both from the added element such as W, Mo, Ta, Pt, Nb, V and Zr, and from the refinement of the chromium particles through the alloying process of the chromium with the added elements. Therefore, the Cu—Cr-based contact materials according to the present invention exhibit excellent large current interrupting and high voltage withstanding characteristics, when compared with the existing Cu—Cr-based contact materials.

The Cu—Cr-based contact materials according to the present invention are able to be manufactured by sintering, infiltration or hot pressing methods, and two kinds of objects of adding the alloy element are as follows:

First, the addition of the heat-resistant metal elements such as W, Mo, Ta, Pt, Nb, V and Zr is to improve the current interrupting and voltage withstanding characteristics of the Cu—Cr-based contact materials.

Second, using the added elements, the size of the chromium particles being dispersed in the copper matrix material becomes fine.

With the manufacturing process of the Cu—Cr-based contact materials for the vacuum interrupters and the technology for the microstructure control thereof in the preferred embodiment of the present invention, the Cu—Cr contact materials with chromium particles having a diameter in a range of about 30 $\mu$m to 90 $\mu$m are manufactured. The raw chromium powder used in the process of the Cu—Cr contact materials has a diameter in a range of 100 $\mu$m to 400 $\mu$m, in order to reduce amount of surface oxide causes to decrease a relative sintered density of the Cu—Cr alloys and to make an electrical characteristic thereof deteriorated. The Mo powder used therein has a diameter of 4 $\mu$m, the W powder 4 $\mu$m, the Ta powder 45 $\mu$m, the Pt powder 45 $\mu$m, the Zr powder 45 $\mu$m, the Nb powder has 45 $\mu$m and the V powder 50 $\mu$m, respectively.

The Cu—Cr-based contact materials according to the present invention have chemical compositions (by weight percent) in the following range:

20% to 80% Cu; 10% to 80% Cr; 0.001% to 80% Mo; 0.001% to 80% W; 0.001% to 80% Ta; 0.001% to 80% Pt; 0.001% to 80% Nb; and 0.001% to 80% V; 0.001% to 80% Zr.

With the compositions as described above, the Cu—Cr-based contact materials according to the present invention can be manufactured by, for example, infiltration, sintering and hot pressing. 1. Infiltration: A chromium powder is mixed with an additive element powder or the chromium powder is mixed with the additive element powder containing a small amount of copper powder. The powder mixtures are uniformly mixed using a V-mixer or a low-speed ball mill, and the mixture is compacted and subjected to a sintering treatment at a temperature in a range of 600° C. to 1070° C., thereby obtaining a porous sintered product (a preliminary sintering).

A pure copper plate is put on the Cr—X porous sintered products (X: as W, Mo, Ta, Pt, Nb, V or Zr) or Cr—X porous sintered products with small amount Cu content and is subjected to heat treatment at a temperature in a range of 1100° C. to 1800° C. higher than a melting point (1083° C.) of the copper, such that a liquid copper is forced to infiltrate into the pores in the porous pre-sintered product, thereby manufacturing a desirable Cu—Cr—X sintered product (an infiltration process).

The infiltration process is carried out in a vacuum or hydrogen atmosphere and may be in an atmosphere of an inert gas such as argon gas or nitrogen gas (after infiltration, in case where the holding time at the sintering temperature is a relatively long, a post-heat treatment for the particle refinement and the solid solution of the alloy element components, as will be below discussed, can be avoided). 2. Sintering: Weighting for each of the copper, chromium and additive element powders is carried out according to the determined compositions, and the powders are homogeneously mixed by using a V-mixer or a low-speed ball mill. The mixed powder is poured into a mold and then subjected to pressing under a pressure of 100 MPa or higher than 100 MPa, thereby producing a Cu—Cr—X compact. The compact is firstly sintered either in a solid state or liquid-phase sintering temperature, thereby completing the solid/liquid two-step sintering process. In case where the holding time at the final sintering temperature is a relatively long, the post-heat treatment for the particle refinement and the solid solution of the alloy element components, as will be below discussed, can be avoided. 3. Hot pressing: Weighting for each of the copper, chromium and additive element powders is carried out according to the determined compositions, and the powders are uniformly mixed by using a V-mixer or a low-speed ball mill. The mixed powder is poured into a mold and then subjected to a pressing using a high temperature press. The temperature of hot pressing is in a range of 600° C. to 1070° C. and the pressure applied is in a range of 1 MPa to 700 MPa. 4. Post-heat treatment: Sintering time for the Cu—Cr—X sintered product having a desirable microstructure using any of the three treatments mentioned above is not substantially long. And, the chromium particles are dissolved by the added element (the alloy element) and then, in order to re-precipitate the alloy element as a solid solution of the Cr-alloy element, the holding time maintained at the sintering temperature after the completion of the sintering is additionally required. Particularly, the sintered-product should be kept for a substantially long time at a high temperature (the sintering temperature), for the purpose of obtaining a Cu—Cr—X sintered product having a uniform microstructure.

The post-heat treatment of the Cu—Cr—X sintered product is done in a range of 1083° C. to 1800° C., and the holding time of the post-heat treatment is dependent upon the temperature. For example, the holding time at 1100° C. is about 20 hour and the holding time at 1800° C. is about 1 hour.

The post-heat treatment is carried out in a vacuum or hydrogen atmosphere and may be in an atmosphere of inert gas such as argon gas or nitrogen gas.

The Cu—Cr—X sintered product having a desirable microstructure where the fine chromium particles are uniformly distributed in the copper matrix is obtained by the control of the microstructure, that is, the post-heat treatment. Both the degree of refinement of the chromium particles and the distribution of alloying elements in the chromium particles depend on the temperature of the post-heat treatment and the holding time of at the heat treatment temperature. Generally, high sintering temperature and long holding time should be required in order to obtain a complete solid solution of Cr-alloying element that does not have any concentration gradient of the added element.

The present invention will now be described in detail by way of particular examples.

EXAMPLE 1

Copper, chromium and heat-resistant element (for example, Mo, W, Ta, Pt, Nb, V and Zr) powders were uniformly mixed, and the mixed powder was inserted into a mold. Then, the mixed powder poured into the mold was pressed under a pressure of 100 MPa or more, thereby manufacturing a Cu-(15 to 75 wt %)Cr-10 wt % heat-resistant element compact having a diameter of 25 mm.

The compact having a relative density of 75% or more was subjected to a single-step sintering (a solid state sintering at the temperatures in a range of 900° C. to 1075° C. or a liquid phase sintering at the temperatures in a range of 1100° C. to 1250° C.) or a solid/liquid two-step sintering, thereby obtaining a sintered product of ternary system, Cu—Cr—X (X: Mo, W, Ta, Pt, Nb, V and Zr).

The sintering time was in a range of 1 hour to 20 hour and the sintering was carried out in a vacuum or hydrogen atmosphere. As shown in FIG.1, the compact was sintered at 1100° C. for 20 hour and at 1800° C. for 1 hour. The degree of vacuum at the sintering was $5\times10^{-5}$ torr and the purity of hydrogen gas was 99.9% or more.

Figure 2:
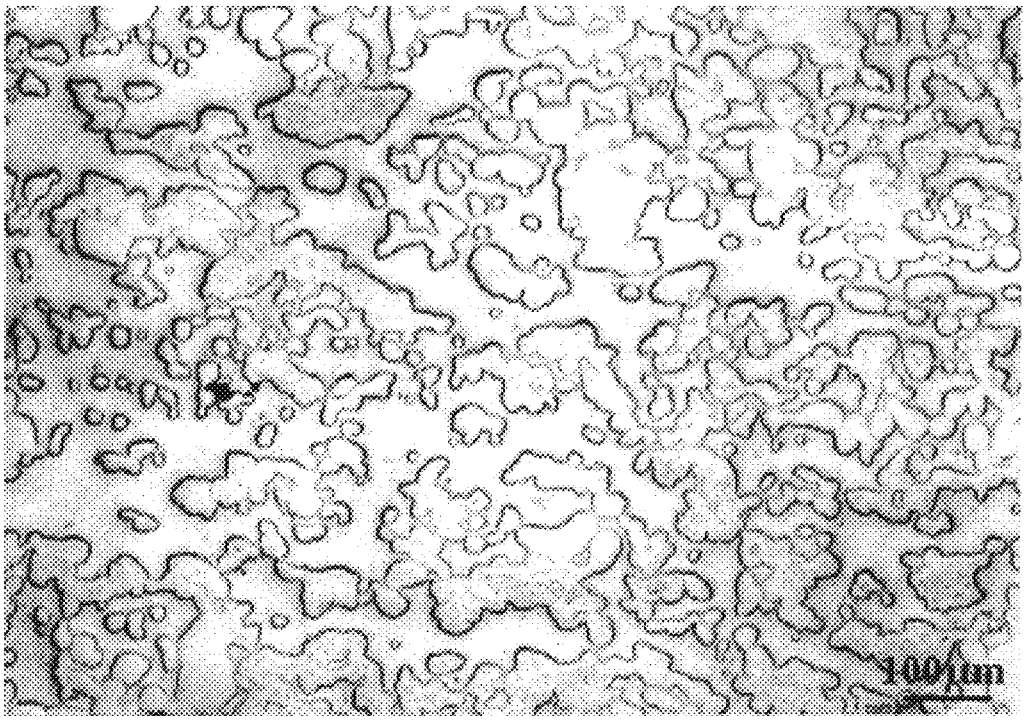
FIG. 2 is a photograph of a Cu-25%Cr-10%W contact material manufactured according to the present invention.
Figure 3:
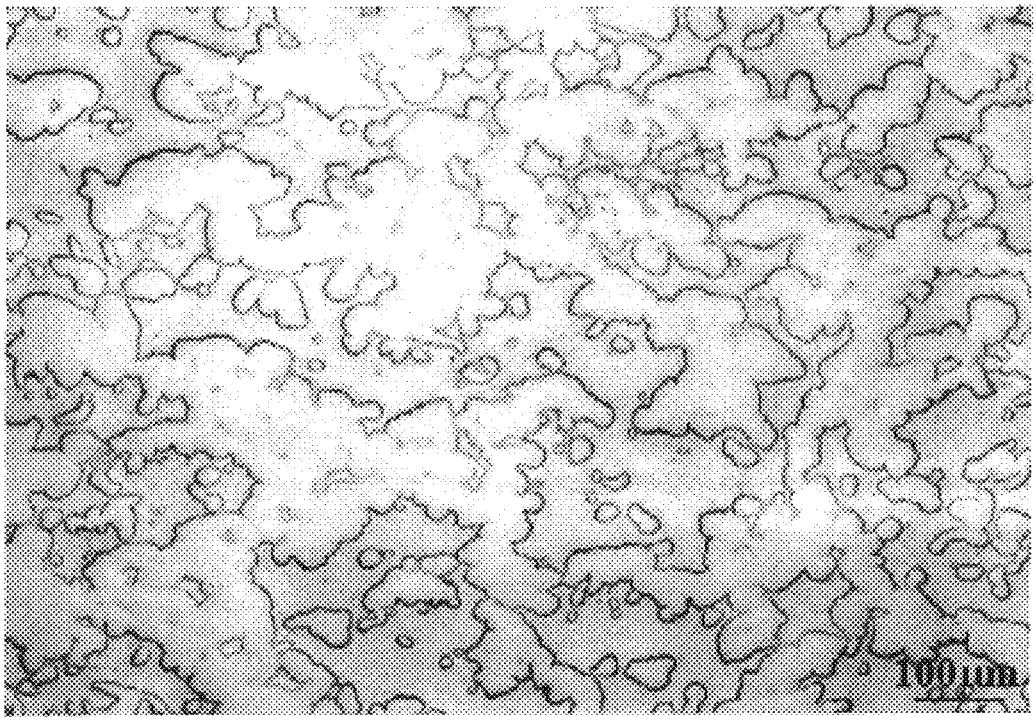
FIG. 3 is a photograph of a Cu-25%Cr-5%Mo contact material manufactured according to the present invention.
Figure 4:
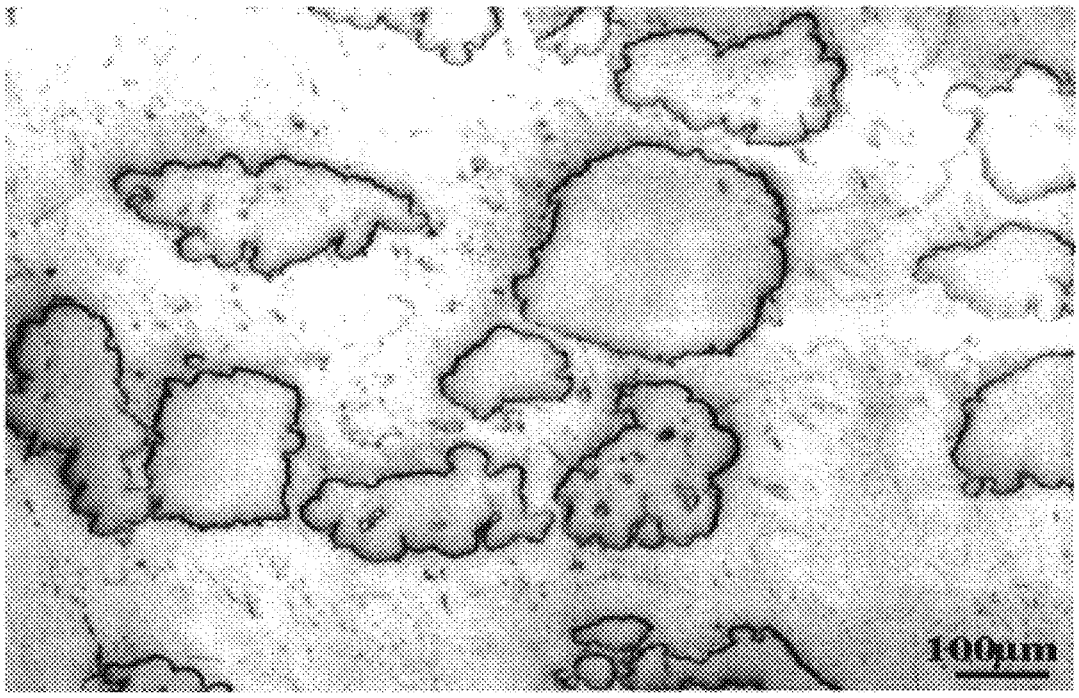
FIG. 4 is a photograph of a conventional Cu-25%Cr contact material.

FIGS. 2, 3 and 4 show microstructures of the Cu—Cr—X sintered products according to Example 1 and a conventional Cu—Cr contact material. It could be found that the size of the chromium particles in the Cu—Cr—X sintered product containing heat-resistant elements was substantially finer than that in the conventional Cu—Cr contact material as shown in FIG. 4.

EXAMPLE 2

Copper, chromium and heat-resistant element (for example, Mo, W, Ta, Nb, V and Zr) powders were uniformly mixed, and the mixed powder was inserted into a mold. Then, the mixed powder poured into the mold was pressed under pressure in a range of 2 MPa to 800 Mpa or more, thereby producing a Cu-15 to 75 wt % Cr-1 to 75 wt % heat resistant element compact having a diameter of 25 mm. And, as shown in FIG. 1, the compact was preliminarily sintered at the temperatures in a range of 600° C. to 1050° C. for 0.5 hour to 10 hour, thereby producing a porous Cu—Cr—X or Cr—X sintered product. Then, a pure copper plate was put on the porous preliminary sintered product and subjected to heat treatment at temperature (in a range of 1100° C. to 1800° C.) higher than a melting point of the copper for 0.5 hour to 20 hour, in which the liquid copper was infiltrated into the porous Cu—15 to 75 wt % Cr-1 to 75 wt % heat resistant element sintered product.

The compact having a relative density of 75% or more was subjected to a single phase sintering (a solid state sintering at the temperatures in a range of 900° C. to 1075° C. or a liquid phase sintering at the temperatures in a range of 1100° C. to 1250° C.) or a solid/liquid two-step sintering, thereby producing a desirable Cu—Cr—X sintered product.

The pre-sintering time was required for 20 hour at 1100° C. and for 1 hour at 1800° C., in order that the chromium particles existing in the interior of the Cu—Cr—X sintered product could be refined. The degree of vacuum upon the vacuum infiltration was $5\times10^{-5}$ torr and the purity of hydrogen gas upon the infiltration was 99.9% or more.

The result of the particle refinement after the infiltration showed a microstructure similar to the sintered microstructures in shown Example 1.

EXAMPLE 3

Copper, chromium and heat-resistant element (for example, Mo, W, Ta, Pt, Nb, V and Zr) powders were uniformly mixed, and the mixed powder was poured into a mold having a diameter of 25 mm. Then, the compact is kept at the temperatures in a range of 600° C. to 1050° C. under at a pressure in a range of 1 MPa to 800 MPa, thereby producing a Cu—Cr—X sintered product. Then, the sintered product was subjected to heat treatment having the same conditions as in Example 1, such that the chromium particles existing in the Cu—Cr—X sintered product could be refined.

As clearly set forth in the above discussion, with a Cu—Cr—X (X: Mo, W, Pt, Ta, Nb, V and Zr) contact material according to the present invention, the diameter of the chromium particles can be reduced to a size about 30 $\mu$m from 120 $\mu$m and a size in a range of 60 $\mu$m to 90 $\mu$m from a size in a range of 200 $\mu$m to 400 $\mu$m. Also, the fine chromium particles include a substantially large amount of heat-resistant element. As a result, the Cu—Cr-based alloy can exhibit improved current interrupting ability and increase voltage withstanding capability.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A method of controlling the microstructures of Cu—Cr-based contact material for vacuum interrupters, said method comprising the steps of:

mixing copper powder using as a matrix material improving an electrical characteristic of the contact material, chromium powder and heat-resistant element powder making the chromium particles in the matrix material fine to thereby obtain mixed powder;

subjecting the mixed powder to one treatment selected from sintering, infiltration and hot pressing treatments to thereby obtain a homogenously sintered product; and, subjecting said sintered product to post-heat treatment, such that said chromium particles can be refined.

2. The method of claim 1, wherein the chromium powder has a particle size in a range of 200 $\mu$m to 300 $\mu$m.

3. The method of claim 1, wherein the heat-resistant element is at least one metal selected from the group of Mo, W, Ta, Pt, Nb, V and Zr.

4. The method of any of claims 1, wherein the copper, chromium and heat-resistant elements have The compositions in the following range: 20% to 80% Cu; 10% to 80% Cr; 0.001% to 80% Mo; 0.001% to 80% W; 0.001% to 80% Pt; 0.001% to 80% Ta; 0.001% to 80% Nb; 0.001% to 80% V and 0.001% to 80% Zr by weight percent.

5. The method of claim 1, wherein said sintering treatment is carried out by using at least one process selected from a solid state sintering process where the mixed powder is sintered in a solid, state at a temperature below a melting point of the copper and a liquid phase sintering process where the mixed powder is sintered in a liquid state at a temperature above the melting point of the copper.

6. The method of claim 1, wherein said infiltration treatment comprises the steps of:

subjecting a compact to a preliminary sintering treatment at a temperature below the melting point of copper to thereby produce a porous pre-sintered product; and putting a copper plate on the preliminary sintered product and subjecting the copper plate to heat treatment at a temperature above the melting point of copper, such that a liquid copper is forced to be infiltrated into the pores in the preliminary sintered product.

7. The method of claim 1, wherein said hot pressing comprises the steps of: uniformly mixing the copper, chromium and heat-resistant powders and inserting the mixed powder to a mold; and subjecting the mixed powder poured into the mold at a pressure in a range of 1 MPa to 500 MPa, while keeping maintaining the temperature of the mold below a melting point of copper.

8. The method of claim 1, wherein said sintering and infiltration treatments are carried out in a vacuum, hydrogen or in an inert gas atmosphere.

9. Cu-Cr-based contact materials for vacuum interrupters manufactured according to a method comprising the steps of:

mixing a copper powder used as a matrix material, a chromium powder improving an electrical characteristic-of the-contact-material and a heat-resistant element powder making the chromium particles in the matrix material fine to thereby obtain mixed powder;

subjecting the mixed powder to one treatment selected from sintering, infiltration and hot pressing to thereby obtain a sintered product; and, subjecting said sintered product to post-heat treatment, such that the chromium particles can be refined.

* * * * *